United States Patent [19]

Allen

[11] Patent Number: 5,011,716

[45] Date of Patent: Apr. 30, 1991

[54] HOLDER FOR BARRETTES

[76] Inventor: Diane Allen, 373 Coolidge Ave., Oceanside, N.Y. 11572

[21] Appl. No.: 516,475

[22] Filed: Apr. 30, 1990

[51] Int. Cl.[5] ..... A45D 8/34

[52] U.S. Cl. ..... 428/4; 132/278; 428/15; 428/28

[58] Field of Search ..... 428/4, 15, 28; 132/278

[56] References Cited

U.S. PATENT DOCUMENTS

| | | | |
|---|---|---|---|
| 1,162,813 | 12/1915 | Slater | 428/16 X |
| 1,480,935 | 1/1924 | Gleason | 132/278 |
| 2,818,871 | 1/1958 | Beaudry | 132/278 |
| 3,550,161 | 12/1970 | Orozco | 428/5 X |
| 4,406,296 | 9/1983 | Wexler et al. | 132/278 X |

*Primary Examiner*—Henry F. Epstein
*Attorney, Agent, or Firm*—James P. Malone

[57] ABSTRACT

A holder for barrettes. A length of braided hair looped through a mounting ring and an elastic band mounted on the end of said braided hair to hold the loose ends together.

2 Claims, 1 Drawing Sheet

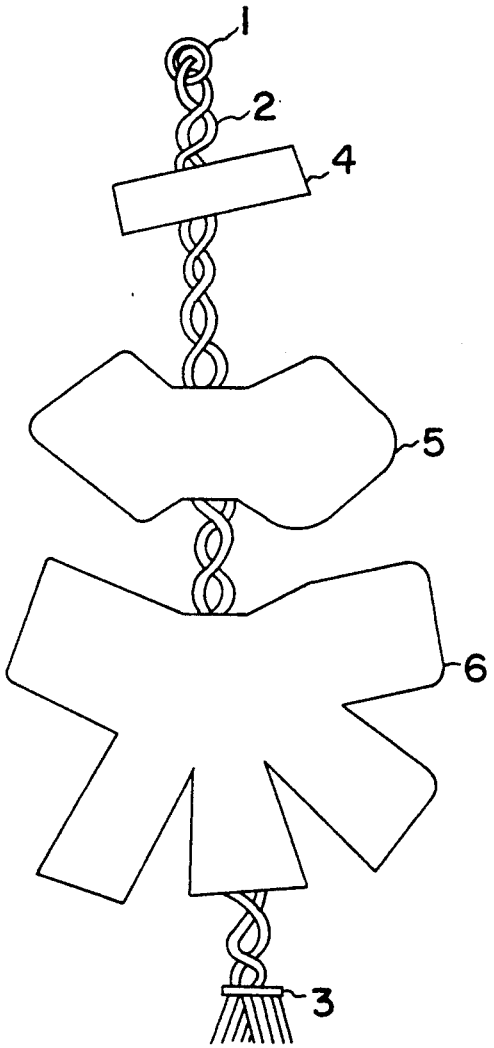
1
2
4
5
6
3

HOLDER FOR BARRETTES

This invention relates to a decorative display holder for barrettes and hair clips.

BACKGROUND

Ladies with long hair frequently use barrettes to clip onto the hair to hold it in place. The barrettes have decorative shapes and colors to match the natural hair or a garment being worn.

THE INVENTION

The present invention provides a conventient display holder for barrettes so that they can be inspected and chosen for matching purposes.

Specifically, the holder comprises a length of braided synthetic hair which is looped through a mounting ring, which may be mounted on a wall or other convenient place.

A plurality of barrettes may be clipped onto the hair braid so that they are easily available for inspection and choice, depending upon what it is desired to match.

OBJECTS OF THE INVENTION

A principal object of the invention is to provide a new and improved display holder for barrettes or hair clips. This, and other objects of the invention, will be apparent from the following specification and drawing, which is a front view of an embodiment of the invention.

BRIEF DESCRIPTION OF DRAWINGS

The drawing is a front view of an embodiment of the invention.

Referring to the drawing, the invention comprises a mounting ring 1, which may be mounted on a wall or other convenient place, a length of braided hair 2 is looped through the ring and suspended in vertical position. The lower end of the braid is gathered together with an elastic band 3.

A plurality of barrettes 4, 5 and 6 may be clipped onto the braid so that they are easily available for inspection and chosing of a desirable barrette, depending on color, matching, etc.

I claim:

1. A holder for barrettes, comprising a mounting ring, adapted to be mounted on a wall, a length of braided hair looped through the mounting ring and an elastic band, mounted on the end of said braided hair, to hold the loose ends together wherein a number of barrettes are mounted on the length of braided hair for easy inspection and selection.

2. The combination of claim 1, wherein the hair is synthetic hair.

* * * * *

UNITED STATES PATENT AND TRADEMARK OFFICE

CERTIFICATE OF CORRECTION

PATENT NO. : 5,011,716

DATED : April 30, 1990

INVENTOR(S) : Diane Alflen

It is certified that error appears in the above-identified patent and that said Letters Patent is hereby corrected as shown below:

TITLE PAGE Item [19] "Allen" should read --Alflen--.

Item [76] should read "Diane Alflen".

Signed and Sealed this

Fifteenth Day of September, 1992

*Attest:*

DOUGLAS B. COMER

*Attesting Officer*

*Acting Commissioner of Patents and Trademarks*